United States Patent [19]

Maier et al.

[11] Patent Number: 4,958,136

[45] Date of Patent: Sep. 18, 1990

[54] CIRCUIT BREAKER WITH INDIVIDUAL GAP ADJUSTMENT AT HIGH AND LOW SETTINGS OF MAGNETIC TRIP

[75] Inventors: Alfred E. Maier, Chippewa Township, Beaver County, Pa.; Antonio W. M. Cabral, Ilha do Governador; Carlos P. S. E. Silva, Rio de Janeiro, both of Brazil

[73] Assignee: Westinghouse Electric Corp., Pittsburgh, Pa.

[21] Appl. No.: 320,647

[22] Filed: Mar. 8, 1989

[51] Int. Cl.[5] ..... H01H 75/10

[52] U.S. Cl. ..... 335/42; 335/176

[58] Field of Search ..... 335/42, 45, 174–176

[56] References Cited

U.S. PATENT DOCUMENTS 4,630,019 12/1986 Maier et al. .

4,691,182 9/1987 Mrenna et al. ..... 333/176

*Primary Examiner*—Leo P. Picard

*Assistant Examiner*—Lincoln Donovan

*Attorney, Agent, or Firm*—M. J. Moran

[57] ABSTRACT

A multiphase circuit breaker has a magnetic trip assembly which includes an adjusting bar slidable longitudinally to simultaneously adjust the bias applied by individual torsion springs to the rotatable armature of the magnetic trip assembly for each pole over a range of trip currents from a high setting to a low setting. Adjusting screws carried by the adjusting bar provide for adjustment of the gap between the armature and stationary magnetic structure independently at the high and low settings separately for each pole. An additional set of adjusting screws can be inserted in the adjusting bar to provide a single adjustment of the gap over the full range of spring bias settings.

9 Claims, 5 Drawing Sheets

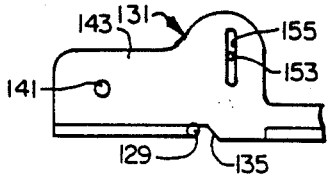
FIG. 10.
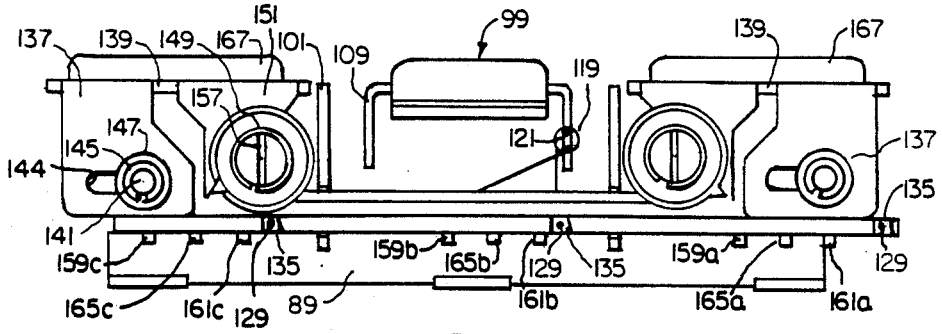
FIG. 7A.
FIG. 7B.
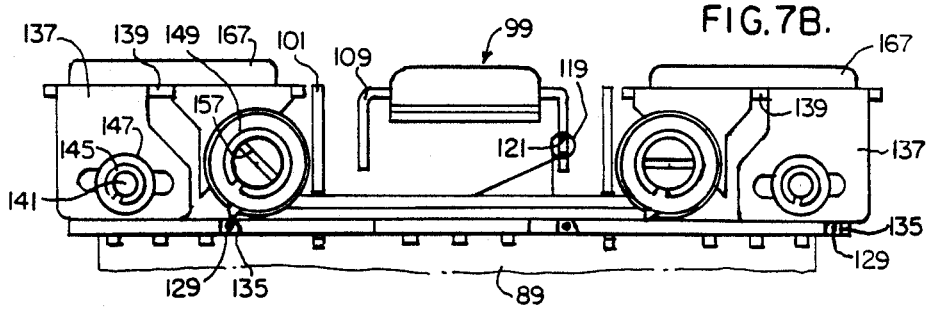
FIG. 8.
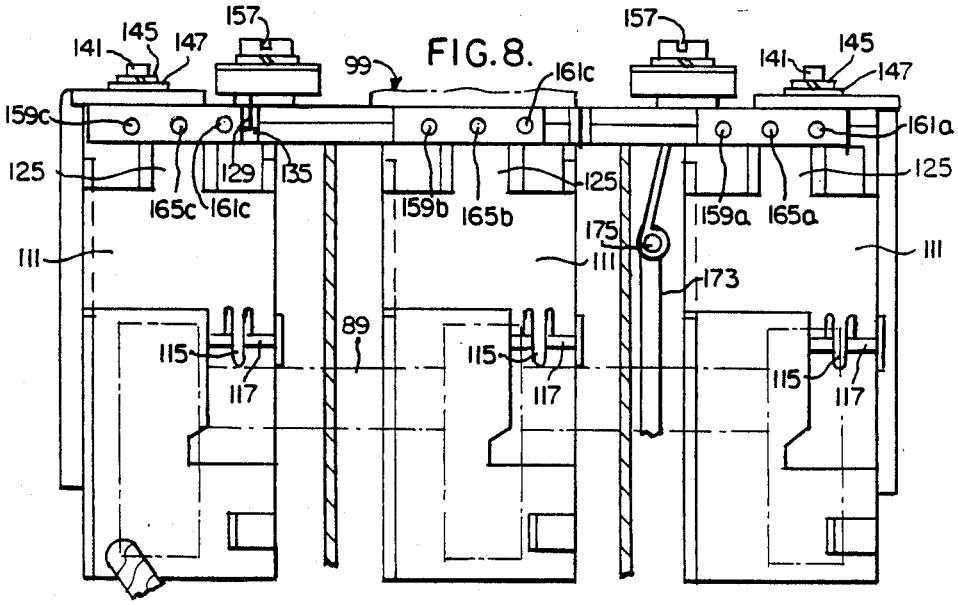

CIRCUIT BREAKER WITH INDIVIDUAL GAP ADJUSTMENT AT HIGH AND LOW SETTINGS OF MAGNETIC TRIP

BACKGROUND OF THE INVENTION

1. Field of the Invention

This invention relates generally to circuit breakers with magnetic trip devices and more specifically to circuit breakers with means for adjusting the gap and spring bias on such magnetic trip devices.

2. Background

Circuit breakers provide protection for electrical systems from electrical fault conditions such as current overloads and short circuits. Typically, circuit breakers include a spring powered operating mechanism which opens electrical contacts to interrupt the current through the conductors on an electrical system in response to abnormal currents. The operating mechanism is unlatched by a trip bar which in turn is operated by a trip mechanism associated with each phase of the electrical system. Typically, the trip mechanism includes a magnetic trip device comprising a fixed magnetic structure energized by the current flowing through the conductor, and a movable armature which is attracted toward the stationary magnetic structure to operate the trip bar. The trip bar in turn unlatches the operating mechanism to open the electrical contacts in each phase of the electrical system. The moveable armature is biased away from the stationary magnetic structure by a spring thereby forming a gap between the armature and the stationary magnetic structure in the absence of an abnormal current.

Usually, means are provided for adjusting the level of current at which the magnetic trip device actuates the operating mechanism. Such adjustments can be made by varying the spring bias applied to the armature and/or mechanically adjusting the gap such as by varying the position of a threaded screw or cam against which the spring biases the armature. These adjustments permit fine tuning of the circuit breaker to assure that it will operate at the desired level of fault current. They can also be used to provide a range of settings at which the circuit breaker will trip. For instance, a circuit breaker may be rated to provide a range of trip settings between a low of say 500 amperes and a high of 1000 amperes.

U.S. Pat. No. 4,691,182 is an example of a circuit breaker having means for adjusting the spring bias and the gap for each pole of the breaker. The spring bias is adjusted individually for each pole by a rotatable cam which pivots a lever to adjust the bias applied to a rotatable armature by a tension spring. A threaded screw provides individual adjustment of the gap between the armature and the stationary magnetic structure. In this circuit breaker, it is not possible to separately adjust the gap at the high and low spring settings. The gap setting is the same for all settings established by the spring bias.

U.S. Pat. No. 4,630,019 discloses a circuit breaker in which the armature of the magnetic trip device is biased by a helically wound torsion spring. The spring bias may be adjusted by engaging one arm of the torsion spring in one of a number of slots in a support plate.

There are some circuit breakers which have been marketed in other countries in which means have been provided for simultaneously adjusting the spring bias on the armatures of the magnetic trip devices for all of the poles of the breaker. Some of these breakers also include means for adjusting the gap between the armature and the stationary magnetic structure through use of a threaded screw or a moveable cam device. However, to applicant's knowledge, none of these circuit breakers provide a means for independently adjusting the gap at the high and low spring settings.

While the common spring adjustment for all poles of a circuit breaker is a decided convenience in selecting the trip setting within the operating range of a breaker, the lack of individual gap adjustment at the high and low spring bias settings on presently available circuit breakers restricts the ability to provide accurate trip settings at both ends of the range of trip settings. For instance, by adjusting the spring bias to the high trip setting and adjusting the gap, it is possible to assure that the breaker will trip within a predetermined tolerance of the high setting. With a common spring adjustment for all poles and individual gap adjustments, this tolerance can be met for the high setting on all of the poles. However, when the spring bias is adjusted to the low trip setting, there is no assurance that the gap setting that was made for the high trip setting will provide a low trip setting within the desired tolerance.

There is a need therefore for a circuit breaker with a magnetic trip device in which gap adjustments may be individually made at high and low trip settings established by adjustment of the spring bias on the armature of the magnetic trip device. There is a preferred need for such a circuit breaker in which the spring bias can be adjusted simultaneously on all the poles of the circuit breaker while separate adjustment is provided for the high and low setting of each of the gaps individually.

SUMMARY

These and other needs are satisfied by the invention comprising a circuit breaker including a latchable operating mechanism operable to open electrical contacts when unlatched, a trip bar rotatable from a biased position to a trip position to unlatch the operating mechanism and a magnetic trip assembly which includes a stationary magnetic structure, a movable armature which is attracted to the stationary magnetic structure by an abnormal current to rotate the trip bar to the trip position, spring means biasing the armature away from the stationary magnetic structure to form a gap therebetween, and adjusting means adjusting biasing of the armature by the spring means over a range from a high setting to a low setting and adjusting the gap independently at the high and low settings More particularly, the adjusting means is a sliding member movable rectilinearly to adjust the spring bias simultaneously on all poles of the circuit breaker, and separate gap adjustment means for each pole carried by the sliding member for independently setting the gap at the high and low spring bias settings. The gap adjustment means for each pole includes a first projection selectively extendable from the sliding member to bear against the armature and adjust the gap only when the sliding member is at about the high setting, and a second projection selectively extendable from the sliding member to bear against the armature and adjust the gap only when the sliding member is at about the low setting.

If desired, a third projection associated with each pole can be selectively extended to bear against the armature and adjust the gap for all settings of spring bias.

BRIEF DESCRIPTION OF THE DRAWINGS

A full understanding of the invention can be gained from the following description of the preferred embodiment when read in conjunction with the accompanying drawings in which:

FIG. 7A is a plan view of the portion of the circuit breaker shown in FIG. 4 illustrating the magnet trip adjustment mechanism of the invention positioned in the high setting.

FIG. 7B is a plan view similar to FIG. 7A but illustrating the adjustment mechanism positioned to an intermediate setting.

FIG. 8 is a vertical section through the circuit breaker taken along a plane perpendicular to the left side of FIG. 4.

FIG. 10 is a plan view of a fragmentary part of the portion of the circuit breaker shown in FIGS. 7A and 8 with parts removed.

DESCRIPTION OF THE PREFERRED EMBODIMENTS

Figure 1:
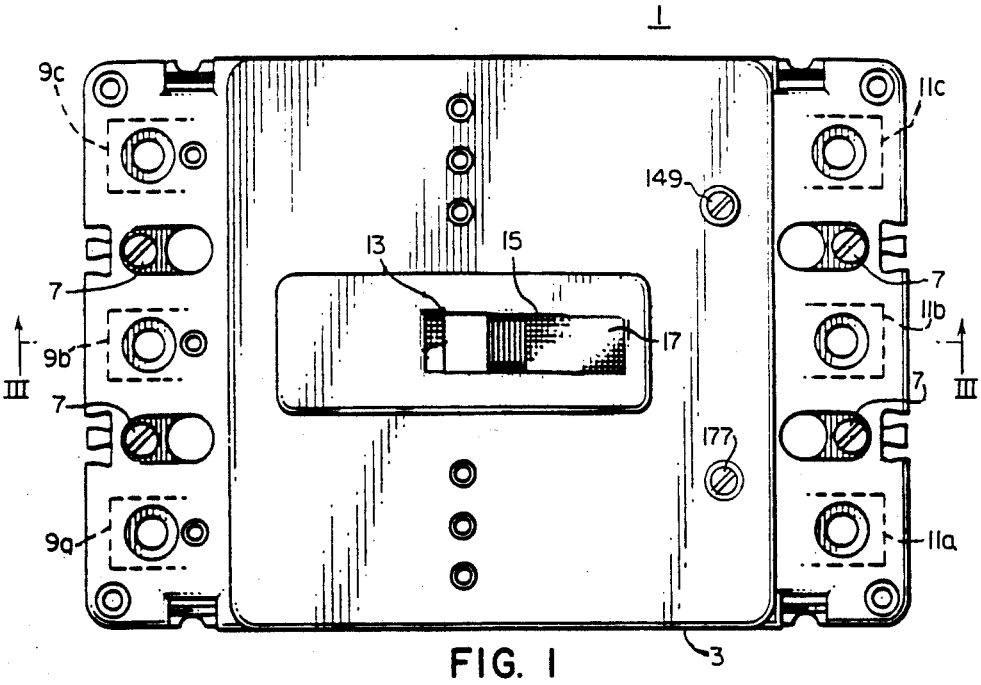
FIG. 1 is a plan view of a circuit breaker incorporating the invention.
Figure 2:
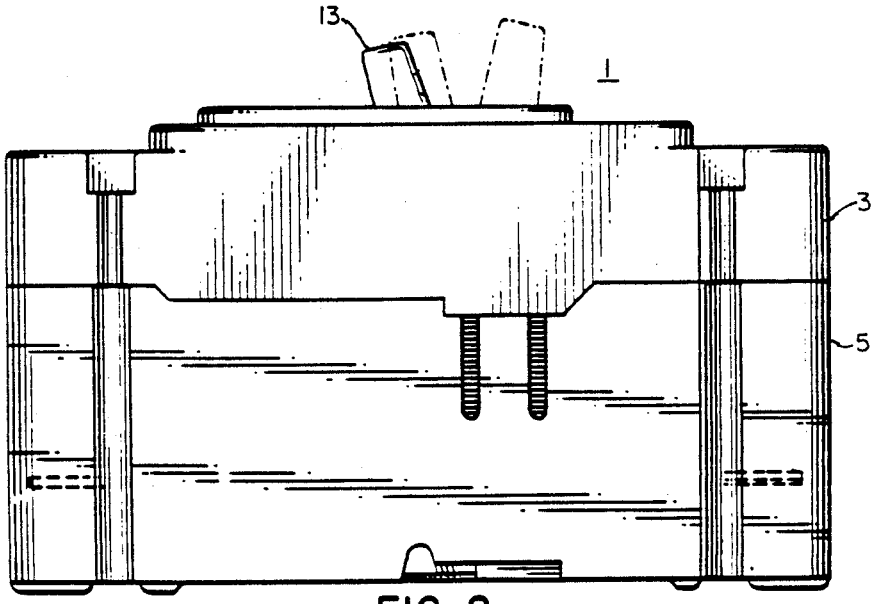
FIG. 2 is a side elevation view of the circuit breaker of FIG. 1.

Referring to the drawings, there is illustrated a molded case circuit breaker 1 incorporating a magnetic trip assembly with the improved means for adjusting the trip set point in accordance with the teachings of the invention. While the circuit breaker 1 is depicted and described herein as a three-phase, or three-pole circuit breaker, the principles of the invention are equally applicable to single phase or polyphase circuit breakers, and to both ac and dc circuit breakers.

The circuit breaker 1 includes a molded, electrically insulting, top cover 3 mechanically secured to a molded, electrically insulating, bottom cover or base 5 by fasteners 7. A set of first electrical terminals, or line terminals 9*a*, 9*b* and 9*c* are provided, one for each pole or phase. Similarly, a set of second electrical terminals, or load terminals 11*a*, 11*b* and 11*c* are provided at the other end of the circuit breaker base 5. These terminals are used to serially electrically connect circuit breaker 1 into a three-phase electrical circuit for protecting a threephase electrical system.

Figure 6:
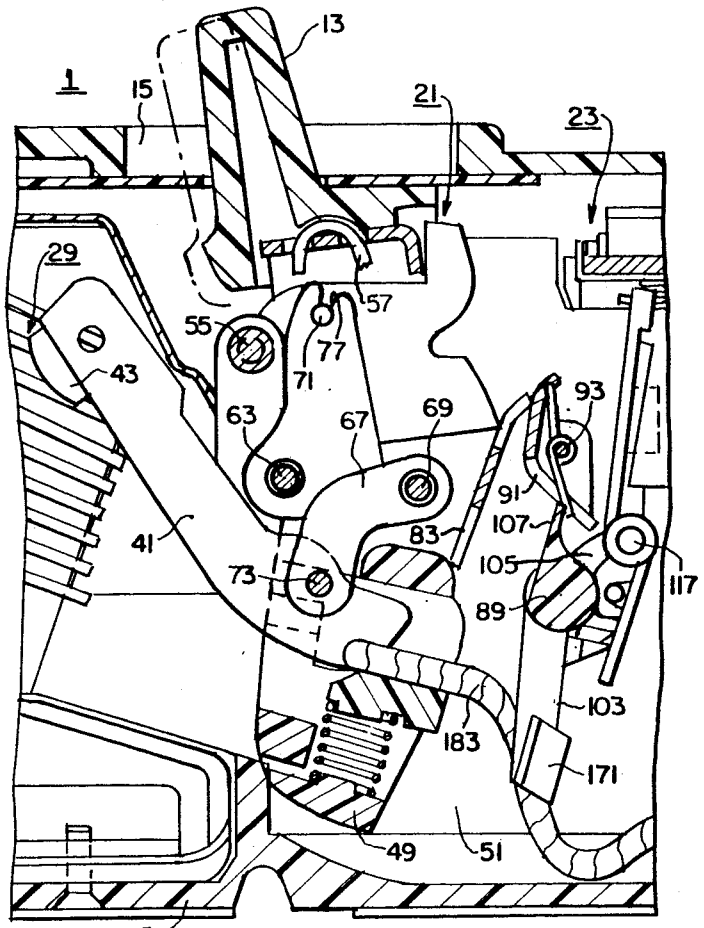
FIG. 6 is an enlarged vertical section of a portion of the circuit breaker of FIG. 1 taken along the same line as FIGS. 3 and 5, but showing the circuit breaker in the tripped position.
Figure 5:
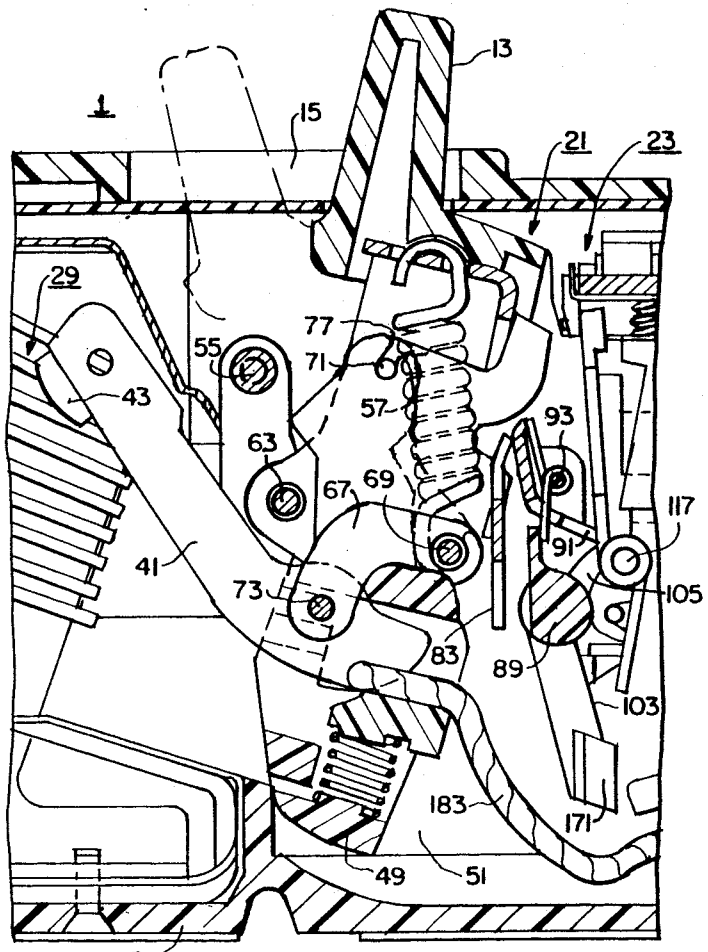
FIG. 5 is an enlarged vertical section of a portion of the circuit breaker of FIG. 1 taken along the same line as FIG. 3 but showing the circuit breaker in the open position.

The circuit breaker 1 further includes an electrically insulating, rigid, manually engagable handle 13 extending through an opening 15 in the top cover 3 for setting the circuit breaker 1 to its CLOSED position (FIG. 3) or its OPEN position (FIG. 5). The circuit breaker 1 may also assume a TRIPPED position (FIG. 6). Circuit breaker 1 may be reset from the TRIPPED position to the CLOSED position for further protective operation by moving the handle 13 through the open position (FIG. 5). The handle 13 may be moved either manually or automatically by an operating mechanism 21 to be described in more detail. Preferably, an electrically insulating strip 17, movable with the handle 13, covers the bottom of the opening 15, and serves as an electrical barrier between the interior and the exterior of the circuit breaker 1.

As its major internal components, the circuit breaker 1 includes a set of electrical contacts 19 for each phase, an operating mechanism 21 and a trip mechanism 23. Each set of electrical contacts includes a lower electrical contact 25 and an upper electrical contact 27. Associated with each set of electrical contacts 19 are an arc chute 29 and a slot motor 31 both of which are conventional. Briefly, the arc chute 29 divides a single electrical arc formed between separating electrical contacts 25 and 27 upon a fault condition into a series of electrical arcs, increasing the total arc voltage and resulting in a limiting of the magnitude of the fault current. The slot motor 31, consisting of either of a series of generally U-shaped steel laminations encased in electrical insulation or of a generally U-shaped electrically insulated, solid steel bar, is disposed about the contacts 25, 27, to concentrate the magnetic field generated upon a high level short circuit or fault current condition thereby greatly increasing the magnetic repulsion forces between the separating electrical contacts 25 and 27 to rapidly accelerate their separation. The rapid separation of the electrical contracts 25 and 27 results in a relatively high arc resistance to limit the magnitude of the fault current. A more detailed description of the arc chute 29 and slot motor 31 can be found in U.S. Pat. No. 3,815,059.

The lower electrical contact 25 includes a U-shaped stationary member 33 secured to the base 5 by a fastener 35, a contact 37 for physically and electrically contacting the upper electrical contact 27 and an electrically insulating strip 39 to reduce the possibility of arcing between the upper electrical contact 27 and portions of the lower electrical contact 25. The line terminal 9 extending exteriorly of the base 5 comprises an integral end portion of the member 33.

The upper electrical contact 27 includes a rotatable contact arm 41 and a contact 43 for physically and electrically contacting the lower electrical contact 25.

The operating mechanism 21 includes an over-center toggle mechanism 47, an integral one-piece molded cross bar 49, a pair a rigid, spaced apart, metal side plates 51, a rigid, pivotable metal handle yoke 53, a rigid stop pin 55, a pair of operating tension springs 57 and a latching mechanism 59.

The over-center toggle mechanism 47 includes a rigid, metal cradle 61 that is rotatable about the longitudinal central axis of a cradle support pin 63 journaled in the side plates 51.

The toggle mechanism 47 further includes a pair of upper toggle links 65, a pair of lower toggle links 67, a toggle spring pin 69 and an upper toggle link follower pin 71. The lower toggle links 67 are secured to either side of the rotatable contact arm 41 of the upper electrical contact 27 by toggle contact pin 73. The ends of the pin 73 are received and retained in the molded cross bar 49. Thus, movement of the upper electrical contact 27, and the corresponding movement of the cross bar 49 are effected by movement of the lower toggle links 67. In this manner, movement of the upper electrical contact 27 by the operating mechanism 21 in the center pole or phase of the circuit breaker 1 simultaneously, through the rigid cross bar 49, causes the same movement in the electrical contacts 27 associated with the other poles or phases of the circuit breaker 1.

The upper toggle links 65 and lower toggle links 67 are pivotally connected by the toggle spring pins 69. The operating tension springs 57 are stretched between the toggle spring pin 69 and the handle yoke 53 such that the springs 57 remain under tension, enabling the operation of the over-center toggle mechanism 47 to be controlled by and be responsive to external movement of the handle 13.

The upper links 65 also include recesses or grooves 77 for receipt and retention of pin 71. Pin. 71 passes through the cradle 61 at a location spaced by a predetermined distance from the axis of rotation of the cradle 61. Spring tension from the springs 57 retains the pin 71 in engagement with the upper toggle links 65. Thus, rotational movement of the cradle 61 effects a corresponding movement or displacement of the upper portions of the links 65.

The cradle 61 has a slot or groove 79 defining a flat latch surface which is configured to engage a flat cradle latch surface formed in the upper end of an elongated slot or aperture 81 in a generally flat intermediate latch plate 83. The cradle 61 also includes a generally flat handle yoke contacting surface 85 configured to contact a downwardly depending, elongated surface 87 formed on the upper end of the handle yoke 53. The operating springs 57 move the handle 13 during a trip operation and the surfaces 85 and 87 locate the handle 13 in the TRIPPED position (FIG. 6) intermediate the CLOSED position (FIG. 3) and the OPEN position (FIG. 5) of the handle 13, to indicate that the circuit breaker 1 has tripped. In addition, the engagement of the surfaces 85 and 87 resets the operating mechanism 21 subsequent to a trip operation by moving the cradle 61 in a clockwise direction against the bias of the operating springs 57 from its TRIPPED position (FIG. 6) to to and past its OPEN position (FIG. 5) to enable the relatching of the latching surfaces on groove 79 and in aperture 81.

Further details of the operating mechanism and its associated molded cross bar 49 can be gained from the description of the similar operating mechanism disclosed in U.S. Pat. No. 4,630,019.

The trip mechanism 23 includes the intermediate latch plate 83, a molded one-piece trip bar 89, a cradle latch plate 91, a torsion spring support pin 93, a double acting torsion spring 95, a magnetic trip assembly 97 and a thermal trip device 99 in the form of a bimetal.

The molded one-piece trip bar 89 is journaled in vertical partitions 101 in the base 5 of the molded case circuit breaker 1 which separate three poles of the circuit breaker. (See FIG. 7.) The trip bar 89 has actuating levers 103 for each pole extending radially downward. (See FIGS. 3, 5, and 6.) A trip lever 105 extending outwardly from the trip bar is engaged by the cradle latch plate 91. Cradle latch plate 91 is mounted for rotation about an axis parallel to the trip bar. One arm of the double acting torsion spring 95 biases the cradle latch plate 91 against the intermediate latch plate 81. The other arm of the torsion spring 95 bears against a vertical projection 107 on the trip bar 89 to bias the trip bar in the counter clockwise direction as viewed in FIG. 3.

Figure 3:
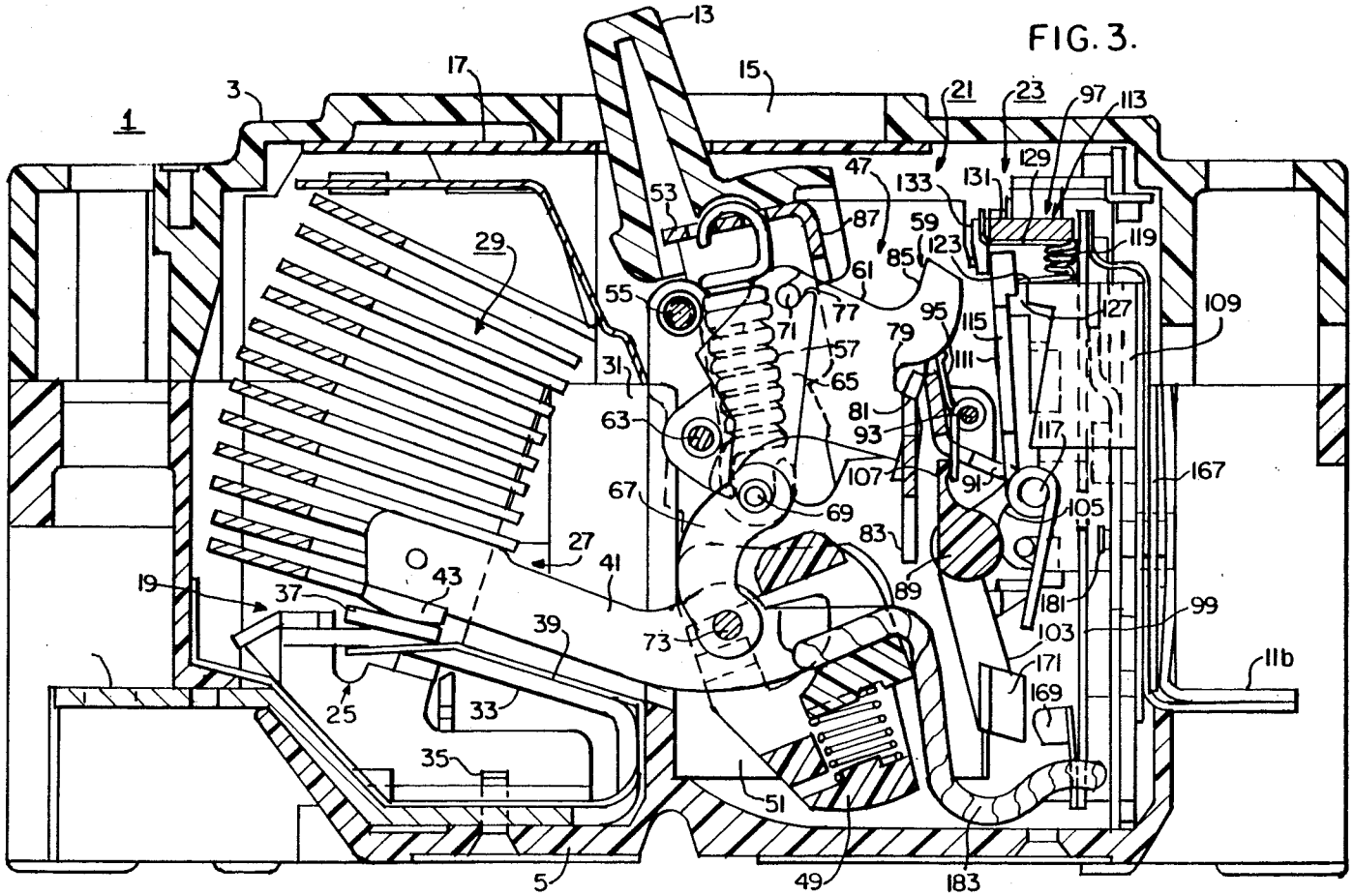
FIG. 3 is an enlarged vertical section through the circuit breaker of FIG. 1 taken along the line 3—3 in FIG. 1 and illustrating the circuit breaker in the closed position.

With the circuit breaker in the CLOSED position as shown in FIG. 3, the tension springs 57 tend to rotate the cradle 61 in the counter clockwise direction. This is resisted, however, by the cradle latch plate 91 held in place by the trip lever 105 on the trip bar 89 and acting through the intermediate latch plate 83.

The magnetic trip assembly 97 includes a stationary magnetic structure 109, an armature 111, and means 113 for adjusting the magnetic trip. The planar armature 111 is bent along a horizontal axis and slotted at 115 for receipt of a pin 117 about which the armature is rotatable.

The adjusting means 113 includes a helical torsion spring 119 supported on a vertical projection 121 (see FIG. 7A. The torsion spring 119 has one spring arm 123 which bears against an upwardly projecting tongue 125 on the armature 111 to bias the armature away from the stationary magnetic structure 109 to form a gap 127 therebetween. The other spring arm 129 of the spring. 119 is engaged by an adjusting bar 131. The adjusting bar 131 includes a depending lip 133 against which the arm 123 of the torsion spring 119 biases the tongue 125 on the armature 111. The upper spring arms 129 of the torsion springs 119 are engaged by notches 135 in the lip 133.

The adjustment bar 131 is supported for rectilinear, longitudinal movement by first horizonal ledges 137 on brackets 139. Upstanding pins 141 on enlarged portions 143 at each end of the adjustment bar 131 extend upward through elongated slots 145 in the ledges 139 (see FIGS. 7 and 10).

Snap rings 145 received in grooves (not shown) in the pins 141 slidably connect the adjustment bar 131 to the bracket ledges 137. Washers 147 are provided between the snap rings 145 and the ledges 137.

A rotatable camming mechanism 149 mounted on a second raised ledge 151 on the bracket 139 adjacent one end of the adjustment bar 131 has an eccentric, depending pin 153 which engages a transverse slot 155 in the enlarged end 143 of the adjustment bar 131. Rotation of the camming device 149 by insertion of a tool such as a screw driver into a slot 157 provide the capability of rectilinearly moving the adjustment bar longitudinally. As can be seen from FIG. 1, the rotatable camming device 149 is accessible through the cover 3 on the circuit breaker 1 to provide means for adjusting the position of the adjusting bar 131 without removing the cover.

Since the spring arms 129 of the torsion spring 119 biasing each of the armatures 111 are engaged by slots 135 in the adjustment bar 131, the bias on the armature 111 for each pole can be adjusted simultaneously by rotating the rotatable camming device 149. With the adjustment bar 131 at the full right end of its travel as shown in FIG. 7*a*, maximum spring bias is applied to the armatures 111 by the springs 119. This provides the high setting for the range of settings of the magnetic trip for the circuit breaker 1.

In order to individually fine tune the setting of each pole of the circuit breaker 1 at this high setting, first projections in the form of screws 159*a*, 159*b* and 159*c* are threaded through the depending flange 133 on the adjustment bar 131 and bear against the back of the tongue 125 on the associated armature. By adjusting the extent that the screws 159*a*, 159*b* and 159*c* project beyond the flange 133, the gap 127 between the armature 111 and the stationary magnetic structure 109 can be individually adjusted for each pole. Thus, while the adjustment bar sets the spring tension on all three poles simultaneously to the high setting, separate adjustment can be made to fine tune the high setting of each pole by use of the screws 159*a*, 159*b* and 159*c*.

When the adjustment bar is moved to the far left, spring bias on each armature 111 is reduced to the low setting for the magnetic trip. With the adjustment bar 131 in this position a set of second projections in the form of screws 161*a*, 161*b* and 161*c* threaded through the flange 133 of the adjustment bar 131 are aligned with the tongue 125 on the associated armature and permit separate adjustment of the gap at this low setting for each of the poles of the circuit breaker 1.

Figure 9A:
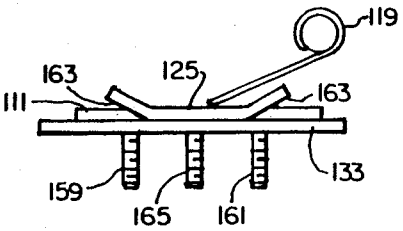
FIGS. 9*a, b* and *c* are schematic drawings illustrating the position of the magnetic trip adjustment bar in the intermediate setting, the high setting, and the low setting, respectively.
Figure 9B:
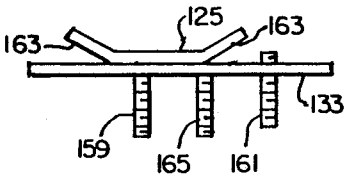
Figure 9C:
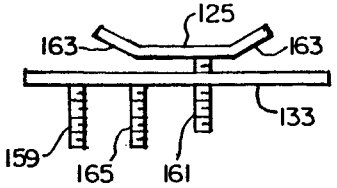

As will seen from the schematic sketches of FIGS. 9*a*, 9*b* and 9*c*, the adjusting screws 159 and 161 are spaced such that the screws 159 are only aligned with the tongue 125 with the armature 111 when the adjusting bar is positioned to the high magnetic trip setting shown in FIG. 9*b*. In this position, the screw 161 has no effect on the gap setting of the armature 111. Conversely, with the adjustment bar 131 position to the low magnetic trip setting shown in FIG. 9*c*, the screw 161 is aligned with tongue 125 to provide adjustment to the gap 127. The side edges 163 of the tongues 125 on the armatures 111 are inclined at an angle to the plane of the armature 111 to provide camming surfaces which guide the armature 111 into the gap setting position established by the screws 159 and 161 as the adjustment bar approaches the high and low settings respectively. The screws 161 and 159 allow gap setting at the high and low spring bias setting to be set independently, and separately for each pole.

An additional set of screws 165*a*, 165*b* and 165*c* can be provided between the screws 159 and 161 adjacent each pole and aligned to bear against the tongue of the associated armature through the entire range of travel of the adjusting bar 131. This additional set of screws remain in contact with the associated tongue 125 throughout the entire range of settings of spring bias, and therefore provides additional flexibility in adjusting the gap 127. With the adjusting bar 131 set in the middle of its travel, as shown in FIGS. 9*a* and 7*b*, only the adjusting screws 165*a*, 165*b* and 165*c* are aligned with the tongues 125 and the gap is set for the entire range of spring bias settings.

Figure 4:
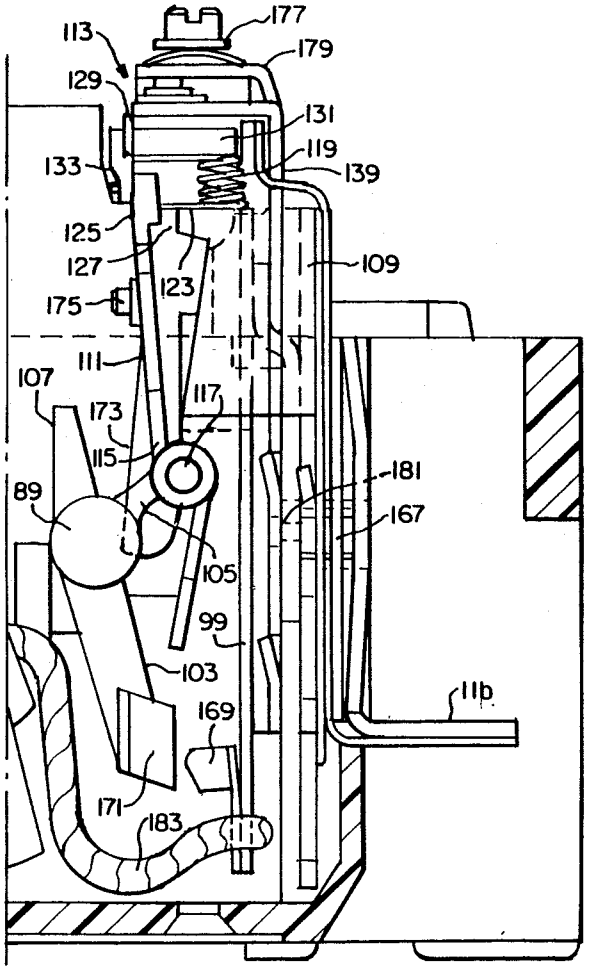
FIG. 4 is an enlarged vertical section of a portion of the circuit breaker of FIG. 1 with the casing removed.

The bimetal 99 is electrically connected to the load terminal 11*b* through a conductive member 167. The lower end of the bimetal 99 is provided with a finger 169 which is spaced from a beveled surface 171 on the lower end of the acuating arm 103 on the trip bar 89. The bevelled surface 171 defines a plane having the left edge as viewed in FIG. 3 closer than the right edge. Adjustment of the spacing between the finger 169 and surface 171 can be accomplished by two means. A lever arm 173 pivoted for rotation about a pin 175 engages the trip bar 89 at its lower end as seen in FIG. 4. The upper end of the lever arm 173 is engaged by a rotatable camming device 177 mounted on a ledge 179 on the bracket 139. The camming device 177 is similar to the device 149. Rotation of the camming device 177 causes the lever arm 173 to rotate sliding the trip bar 89 axially. Due to the bevelled surface 171 on the actuating lever 103, spacing between the bimetal and the trip bar is adjusted. The camming device 177 is also accessible through the top cover of the circuit breaker 1 as shown in FIG. 1. Calibration of the bimetal can be effected at the factory through rotation of a screw 181.

A current bearing conductive path between the lower end of the bimetal 99 and the upper electrical contact 27 is achieved by a flexible copper shunt 183 connected by any suitable means, for example by brazing to the lower end of the bimetal 99 and to the upper electrical contact 27 within the cross bar 49. In this manner, an electrical path is provided through the circuit breaker 30 between the terminals 9*b* and 11*b* via the lower electrical contact 25, the upper electrical contact 27, the flexible shunt 183, the bimetal 99, and the conductive member 167.

Adjustment of the camming device 177 varies the response time of the circuit breaker to low level over currents. Since the bimetal is surrounded by the stationary magnetic structure 109, the current conducted by the bimetal generates a magnetic field in the stationary magnetic structure which attracts the armature 111. The spring bias set by adjustment of the adjusting bar 131 through rotation of the camming device 149 adjusts the level of current at which the armature is attracted to the stationary magnetic structure. The screws 159, 161 and 165 provide for fine adjustment of the trip current at the high, low and all settings of spring bias respectively.

In operation, the circuit breaker 1 is set to the closed position as shown in FIG. 3. A current which exceeds the magnetic trip setting established by the spring bias through the camming device 149 and the adjusting screws 159, 161 and 165 generates a magnetic field in the stationary magnetic structure 109 sufficient to pull the armature 111 toward it in a clockwise direction is viewed in FIG. 3. The lower end of the armature rotates the trip bar in the clockwise direction until the cradle latch plate 91 slides off of the trip lever 105. This unlatches the cradle 61 permitting the operating tension springs 57 to rotate the cradle 61 counter-clockwise as viewed in FIG. 3 which causes the toggle mechanism 47 to break over to the position shown in FIG. 6 thereby opening a set of electrical contacts 19. As previously mentioned, this results in rotation of the cross bar 49 which opens the sets of contacts 19 on each of the poles of the circuit breaker 1.

In a similar manner, a persistent low level current causes the bimetal 99 to bend bringing the finger 169 into contact with the camming surface 171 of the trip lever 105 on the trip bar 89 thereby rotating the trip bar 89 and tripping the circuit breaker in the manner discussed above in connection with the magnetic trip.

With the circuit breaker tripped, the contacts are opened as shown in FIG. 6. The circuit breaker 1 is reset by moving the handle 13 to the OFF position as shown in FIG. 5. This rotates the cradle 61 to a position where the cradle latch plate 91 biased by the latch torsion spring 95 urges the intermediate latch plate 83 into engagement with the latching surface of the groove 79 in the cradle 61. The latch torsion spring 95 also rotates the trip bar counter-clockwise until the cradle latch plate 91 is engaged and retained in a latched position by the lever 105 on the trip bar 89 as shown in FIG. 5. The trip mechanism 23 is thus relatched and ready for closing of the circuit breaker by movement of the handle 13 to the CLOSED position shown in FIG. 3. This causes the toggle mechanism 47 to rotate counter-clockwise over center, thereby .closing the sets of electrical contacts 19 for each pole.

If it is desired to adjust the instantaneous trip set point of the circuit breaker 1, a screw driver or other tool is inserted in the rotatable camming device 149 and rotated to move the adjustment bar 131 in a desired direction, the required amount. It is desired to adjust the trip delay, a tool is inserted in the camming device 177 and rotated to pivot the lever arm 173 thereby axially displacing the trip bar 89 to adjust the gap between the finger 169 on the bimetal 99 and a beveled surface 171 on the actuating arm 103 of the trip bar 89. The gap 127 between the armatures 111 and a stationary magnetic structures 109 for each pole are set individually for each pole, and independently for the high and low range settings of the circuit breaker 1, by adjustment of the screws 159 and 161, or full range adjustment can be made by adjustment of the screws 165. These gap adjustments are normally performed at the factory to calibrate the circuit breaker 1.

While specific embodiments of the invention have been described in detail, it will be appreciated by those skilled in the art that various modifications and alternatives to those details could be developed in light of the overall teachings of the disclosure. Accordingly, the particular arrangements disclosed are meant to be illustrative only and not limiting as to the scope of the invention which is to be given the full breadth of the appended claims and any and all equivalents thereof.

What is claimed is:

1. A circuit breaker for responding to abnormal currents in a conductor in an electrical system, comprising:

electrical contacts operable between a closed position in which a circuit is completed through the conductor and an open position in which the circuit through the conductor is interrupted;

a latchable operating mechanism operable to open said electrical contacts when unlatched;

a trip bar rotatable from a biased position to a trip position to unlatch said operating mechanism; and a magnetic trip assembly, comprising:

a stationary magnetic structure;

a movable armature which is attracted to the stationary magnetic structure by an abnormal current through said conductor to rotate said trip bar to the trip position;

spring means biasing said armature away from said stationary magnetic structure to form a gap therebetween;

adjusting means adjusting biasing of said armature by said spring means over a range from a high setting to a low setting and adjusting said gap independently at said high and low settings;

pivot means pivotally mounting said movable armature for rotation about a pivot axis; and said adjusting means including a sliding member movable rectilinearly generally parallel to said pivot axis to adjust biasing of said armature between said high and low settings, and gap adjustment means carried by said sliding member and including a first selectably extendable projection aligned to selectably bear against said armature and adjust said gap only when said sliding member adjusts biasing of said armature to about said high setting and a second selectably extendable projection aligned to bear against said armature and adjust said gap only when said sliding member adjusts biasing of said armature to about said low setting.

2. The circuit breaker of claim 1 wherein:

said armature has a generally planar portion extending in a plane generally parallel to said pivot axis and against which said sliding member and said first and second selectably extendable projections bear, said planar portion having camming surfaces on side edges thereof which guide said first and second selectably extendable projections into engagement with said planar portion as said sliding member moves rectilinearly to bring one of said selectably extendable projections into alignment with said planar portion of said armature.

3. The circuit breaker of claim 1 wherein said spring means comprises a torsion spring having a first spring arm bearing against and biasing said armature toward said sliding member and said gap adjustment means, and a second spring arm engaged by said sliding member and moveable therewith to adjust biasing of said armature.

4. The circuit breaker of claim 3 wherein said torsion spring is helically wound about an axis transverse to said pivot axis and is mounted on said stationary magnetic magnetic structure.

5. The circuit breaker of claim 4 wherein:

said armature has a generally planar portion extending in a plane generally parallel to said pivot axis and against which said sliding member and said first and second selectably extendable projections bear, said planar portion having camming surfaces on side edges thereof which guide said first and second selectably extendable projections into engagement with said planar portion as said sliding member moves rectilinearly to bring one of said selectably extendable projections into alignment with said planar portion of said armature.

6. The circuit breaker of claim 1 wherein said gap adjustment means includes a third selectably extendable projection carried by said sliding member aligned to selectably bear against and adjust said gap at all biasing settings by said spring means.

7. A circuit breaker for responding to abnormal currents in conductors associated with each phase in a multiphase electrical system comprising:

a set of electrical contacts for each phase of the multiphase electrical system completing an electrical circuit through an associated conductor when closed and interrupting the circuit when open;

a latchable spring powered operating mechanism operable to open all of said sets of electrical contacts when unlatched;

a trip bar rotatable from a biased position to a trip position to unlatch said operating mechanism;

a magnetic trip assembly for each phase of the multiphase electrical system each comprising:

a stationary magnetic structure;

a pivotally mounted armature rotatable about a pivot axis toward the stationary magnetic structure to rotate the trip bar to the trip position in response to an abnormal current through the associated conductor;

spring means biasing said armature away from said stationary magnetic structure to form a gap therebetween; and adjusting means simultaneously adjusting biasing of all of said armatures by said spring means over a range between a high setting and a low setting and individually adjusting the gap of each armature independently at said high and low settings.

8. The circuit breaker of claim 7 wherein said pivot axes of said armatures are axially aligned, and wherein said adjusting means comprises:

a sliding member slidable rectilinearly in a direction generally parallel to the pivot axes of said armatures to simultaneously adjust biasing of all of said armatures by said spring means between said high and low settings; and gap adjustment means associated with each armature, carried by said sliding member, and each comprising:

a first selectably extendable projection aligned to selectively bear against the associated armature and adjust said gap only when said sliding member adjusts biasing of the armatures to about said high setting; and a second selectably extendable projection aligned to selectably bear against the associated armature and adjust said gap only when said sliding member adjusts biasing of said armatures to the low setting.

9. The circuit breaker of claim 7 including:

a molded case in which said sets of electrical contacts, operating mechanism, trip bar, magnetic trip assemblies and adjusting means are housed, and rotatable range setting means connected to translate rotation thereof into said rectilinear sliding of said sliding member, said rotatable range setting means being accessible through said molded case such that biasing of said armatures over said range between said high and low settings can be effected without opening said molded case.

* * * * *